United States Patent [19]

Kashio

[11] 4,170,105

[45] Oct. 9, 1979

[54] ELECTRONIC TIMEPIECE

[75] Inventor: Toshio Kashio, Tokyo, Japan

[73] Assignee: Casio Computer Co., Ltd., Tokyo, Japan

[21] Appl. No.: 796,521

[22] Filed: May 13, 1977

[30] Foreign Application Priority Data

May 14, 1976 [JP] Japan ..... 51-55176

[51] Int. Cl.[2] ..... G04C 3/00; G04C 9/00; G04F 10/04

[52] U.S. Cl. ..... 58/23 R; 58/4 A; 58/39.5; 58/58; 58/74; 58/85.5

[58] Field of Search ..... 58/4 A, 23 R, 39.5, 58/50 R, 58, 74, 85.5

[56] References Cited

U.S. PATENT DOCUMENTS

| | | | |
|---|---|---|---|
| 3,994,124 | 11/1976 | Fujita | 58/23 R |
| 4,023,345 | 5/1977 | Imamura | 58/39.5 |
| 4,034,551 | 7/1977 | Ushiyama | 58/85.5 |
| 4,058,971 | 11/1977 | Epperson | 58/39.5 |
| 4,090,350 | 5/1978 | Nomura | 58/23 R |

*Primary Examiner*—Stanley J. Witkowski
*Attorney, Agent, or Firm*—Frishauf, Holtz, Goodman and Woodward

[57] ABSTRACT

An electronic timepiece which comprises a time-counter for counting a number of reference clock pulses issued from a reference oscillator; a control circuit for controlling the selection of various functions; a display device for displaying count values corresponding to the various functions; and at least two independently provided manually operative switching devices. The condition in which the at least two switching devices are jointly operated is detected by an AND circuit. The period of time during which the AND circuit continues to send forth an output signal indicating the joint operation of the two switching devices is measured and a function-designating circuit specifies that one of the various functions instructed by the control circuit which corresponds to the measured period of time of joint operation of the two switching devices. Any function specified by the function-designating circuit is carried out by one of the at least two switching devices.

13 Claims, 8 Drawing Figures

ELECTRONIC TIMEPIECE

BACKGROUND OF THE INVENTION

This invention relates to an electronic timepiece provided with improved means for selecting not only time display but also many other functions for which said electronic timepiece is designed.

An electronic timepiece counts time by clock pulses issued from a reference oscillator, for example, a quartz oscillator having a stable oscillation frequency characteristic. The electronic timepiece tends to be more widely accepted due to high precision of time counting. Most of the electronic timepieces developed to date are of the digital display type admitting of a correct and easy reading of time indication.

The digital display timepiece is fundamentally so arranged as to cause time units such as "hours", "minutes" and "seconds" to be indicated by clock pulses sent forth from a reference oscillator. A digital display device displays under electronic control the number of clock pulses counted by a time-counting section which denotes the respective time units.

The above-mentioned digital display type electronic timepiece, indicates not only the above-mentioned time units but also the calendar months and days and the days of the week easily by counting means with time indication on the digital display section changed over to information on the date.

With the digital display type electronic timepiece which is fundamentally designed to count clock pulses issued and display a counted number of said clock pulses on a digital display section, it is easy to incorporate not only the basic timepiece function of indicating the aforesaid time units and the calendar dates, but also, for example, a stopwatch function and a function of a special counter designed to count, for example, a number of commodities, instead of time. Therefore, it is contemplated to render the electronic timepiece as a multifunction device.

While it is important to allow an electronic timepiece to have many functions as described above, it is absolutely necessary for a timepiece to carry out a time-setting operation in order to correct time indication. Namely, an electronic timepiece should be provided with means for issuing various instructions to select the functions not only for the above-mentioned multifunctions but also for control or correction of actual time indication. Where, however, an electronic timepiece is limited in size to serve as a wrist watch, it is practically difficult to fit the electronic timepiece with a large number of instruction-issuing means such as a push button. Though it is theoretically possible in terms of a circuit arrangement to incorporate many functions in an electronic timepiece, yet considerable difficulties arise in forming an electronic wrist watch into a multifunction type.

SUMMARY OF THE INVENTION

This invention has been accomplished in view of the above-mentioned circumstances and is intended to provide an electronic timepiece admitting of the issue of various instructions for controlling display, correcting time indication and selecting a desired one from among the previously described multifunctions.

According to an aspect of this invention, there is provided an electronic timepiece having a counting circuit for counting reference clock pulses issued from a reference oscillator, a function control circuit and a display device, the improvement being that said electronic timepiece further comprises detecting means for detecting the condition in which at least two independent manually operative switching devices are jointly operated; function setting means for determining a period of time during which the detecting means continues to send forth an output signal indicating the joint operation of the at least two switching devices and for designating one of the various functions of the electronic timepiece which corresponds to the period of the joint operation of the at least two switching devices; and means for carrying out the designated function upon operation of at least one of the at least two switching devices.

The electronic timepiece of this invention arranged as described above has the characteristics that the manner in which at least two switching devices incorporated in the electronic timepiece are jointly operated selects a specified one from many various functions; at least one of the at least two switching devices carries out the selected function; and a smallest possible number of switching devices can select a specified one from among a far larger number of functions, thereby prominently elevating the various functions of the electronic timepiece and simplifying its operation control.

DETAILED DESCRIPTION OF THE PREFERRED EMBODIMENTS

Figure 1A:
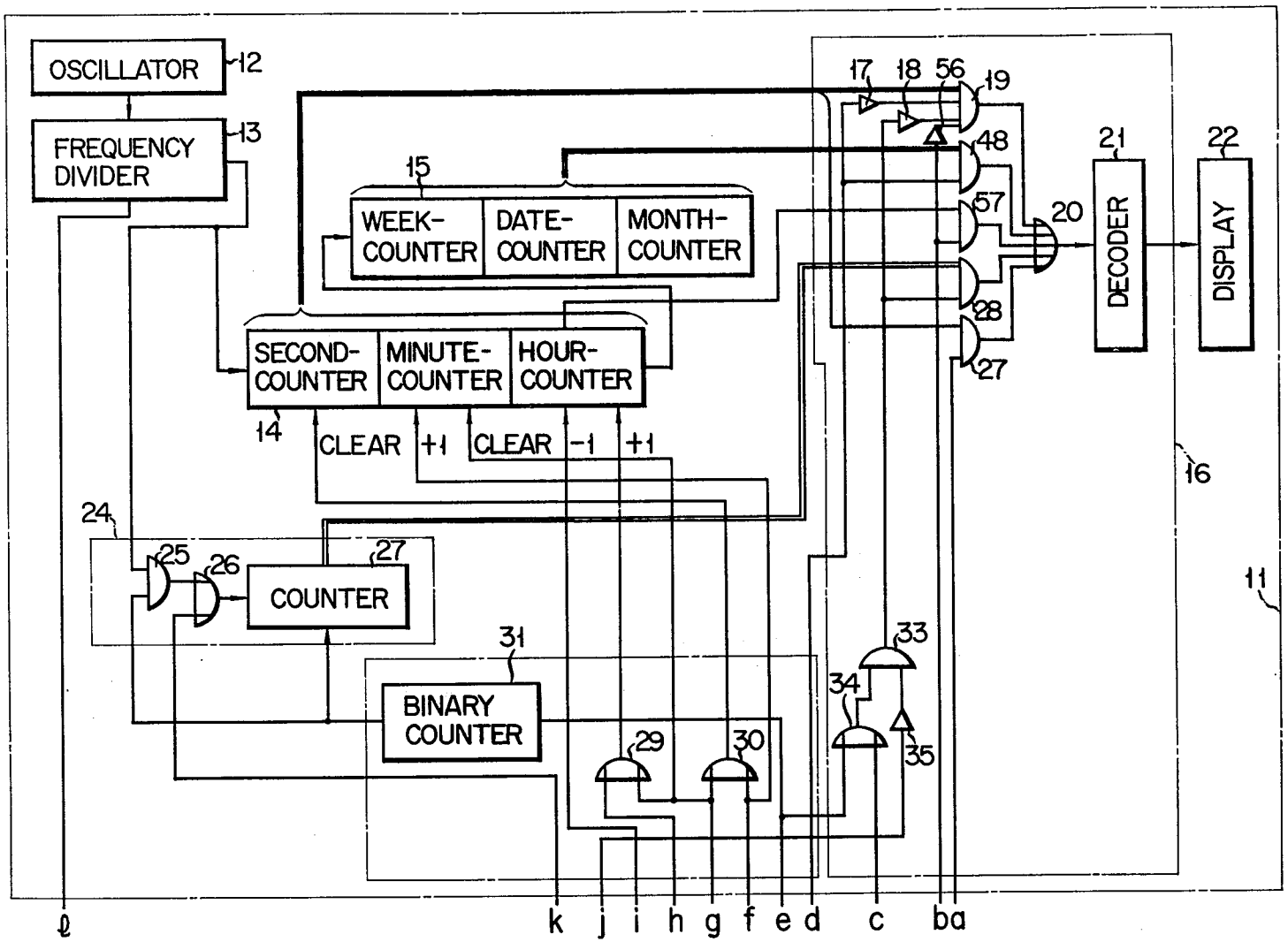
FIGS. 1A and 1B jointly show a block circuit diagram of an electronic timepiece embodying this invention.
Figure 1B:
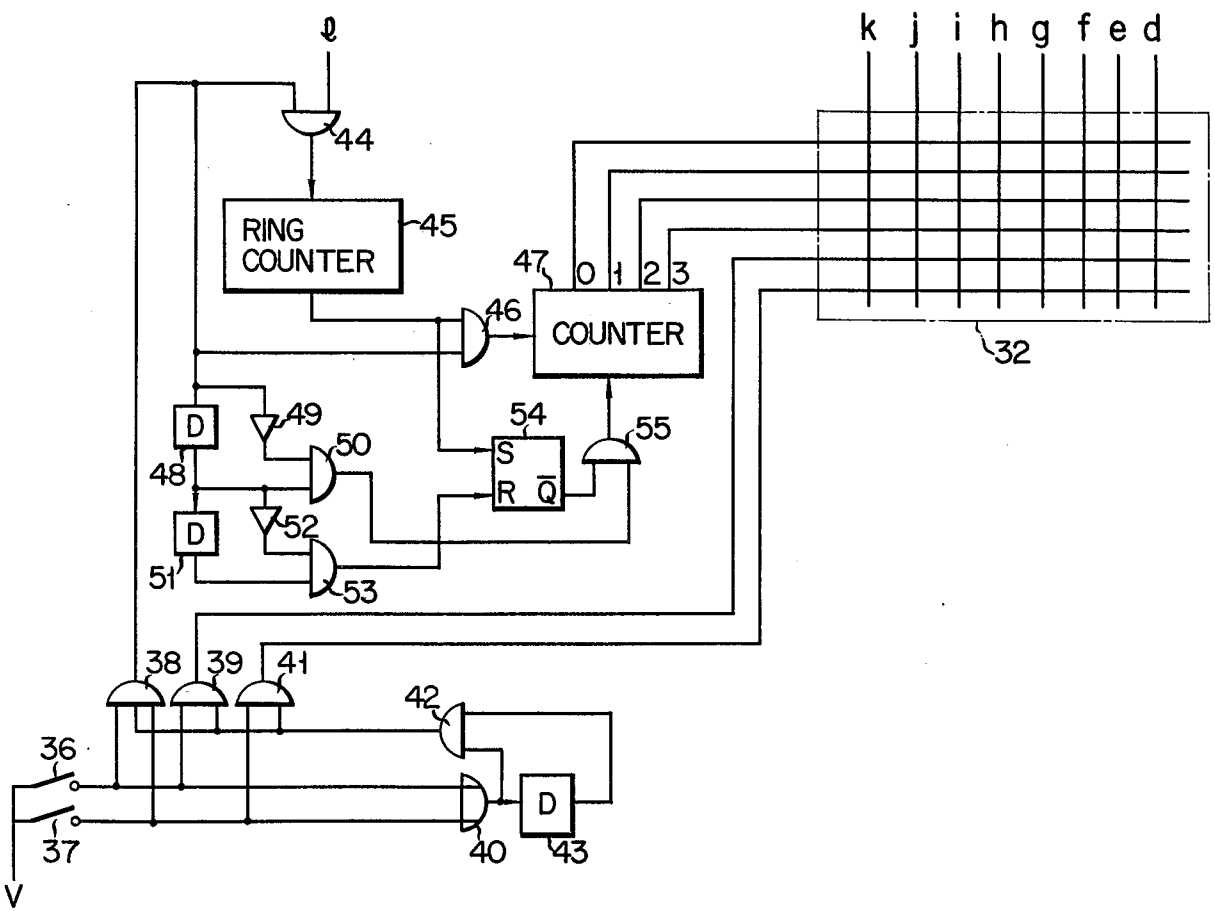

There will now be described by reference to the appended drawings an electronic timepiece embodying this invention. FIGS. 1A and 1B jointly show the arrangement of the electronic timepiece. A region 11 enclosed in broken lines denotes the body of the electronic timepiece.

This electronic timepiece body 11 comprises a reference oscillator 12 formed of, for example, a quartz oscillator. Clock pulses issued from the reference oscillator 12 are converted into clock pulses sent forth at the rate of, for example, one pulse per second, after being conducted through a frequency divider 13. These converted clock pulses cause a time counter 14 to count the corresponding time units of "second", "minutes" and "hours". Time-counting clock pulses are supplied through a display control circuit 16 to a digital display device 22 on which current time is indicated.

The time counter 14 generates one pulse signal per day, namely, for every 24 hours. This pulse signal is conducted to a date counter 15 which counts numerals corresponding to the days of the week, and the calendar months and days. Information on a date counted by the date counter 15 is delivered to the display control circuit 16, which in turn causes the date information to be digitally displaced on the display device 22.

In the normal condition in which the particular instruction, for example, on the display of a date is received, the display control circuit 16 is supplied with output signals from the inverters 17, 18 and causes ordinary time counts made by the time counter 14 to be indicated on the display device 22 through the AND circuit 19, OR circuit 20 and decoder 21. Any other instruction than on the display of time is given to the display control circuit 16 upon receipt of an output signal from a control circuit 23. A clock pulse delivered from the frequency divider 13 is conducted to the gate of an AND circuit 25 included in a function-counting circuit 24 which counts time when the subject electronic timepiece is used, for example, as a stopwatch. The function-counting circuit 24 comprises the AND circuit 25, OR circuit 26 and counter 27. When the other gate of the AND circuit 25 receives an instruction from the control circuit 23, then a clock pulse issued from the frequency divider 13 is conducted through the OR circuit 26 to be counted by the counter 27, thereby enabling the subject electronic timepiece to act as a stopwatch. Where, however, need arises, the function-counting circuit 24 may be made simply to count output signals issued from the control circuit 23 in order to serve as an enumerator for counting, for example, commodities one by one. In this case, count signals are supplied to the gate of an AND circuit 28 included in the display control circuit 16 as are the count signals for a stopwatch function. The above-mentioned count signals issued from the function-counting circuit 24 used as an enumerator are displayed on the display device 22. The control circuit 23 comprises OR circuits 29, 30. According to an instruction given by a function-selecting circuit 32 formed of, for example, a matrix circuit, the control circuit 23 supplies the time counter 14 with a time count-clearing instruction, thereby effecting, for example, time correction. The control circuit 23 further comprises a binary counter 31. When a switching device is continuously thrown in, the function-selecting circuit 32 issues a function-specifying signal. Depending on said function-specifying signal, the binary code of an output signal from the binary counter 31 is reversed to cause the counter 27 to carry out, for example, a stopwatch function.

One gate of the AND circuit 28 included in the display control circuit 16 is supplied with an output count signal from the counter 27. The other gate of said AND circuit 28 receives an output signal from an AND circuit 33. One of the gates of said AND circuit 33 receives an output signal from the control circuit 23 through an inverter 35. The other gate of said AND circuit 33 is supplied through an OR circuit 34 with an output signal from the control circuit 23 or an output signal from the function-selecting circuit 32. An output signal from said AND circuit 33 is transmitted to the inverter 18.

Figure 2A:
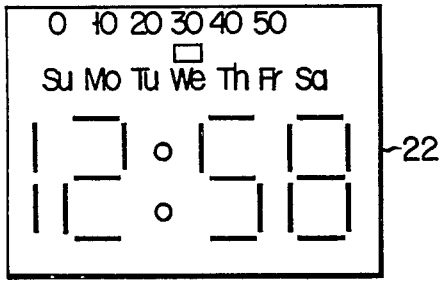
FIGS. 2A to 2F set forth patterns of indications on the display device corresponding to the various functions of the electronic timepiece of the invention.
Figure 2B:
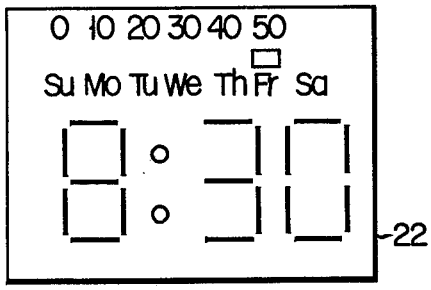
Figure 2C:
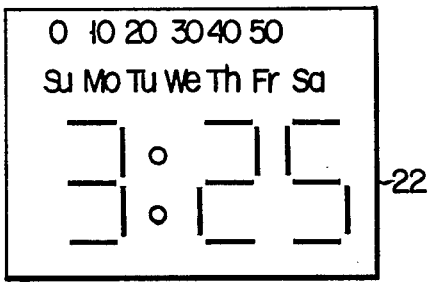

The control circuit 23 for issuing instructions for various functions is operated by first and/or second switches 36, 37 actuated, for example, by operation of a push button. When thrown in, the switches 36, 37 issue a binary coded signal "1" due to the presence of a power source voltage V. An operation signal sent forth from the switch 36 is conducted to AND circuits 38, 39 and OR circuit 40. An operation signal issued from the switch 37 is transmitted to AND circuits 38, 41 and OR circuit 40. An output signal from the OR circuit 40 is delivered to an AND circuit 42 and a delay circuit 43. An output signal from the delay circuit 43 is supplied to the AND circuit 42. When one of the switches 36, 37 is operated for a period of time specified by the delay circuit 43, then the AND circuit 42 generates an output signal, which in turn is transmitted to the gates of the AND circuits 38, 39, 41. When the first and second switches 36, 37 are operated jointly, then the AND circuit 38 sends forth an output signal. When the switch 36 or 37 is operated alone, the AND circuit 39 or 41 generates an output signal. Since the delay circuit 43 is provided, it is possible to prevent an erroneous function-selecting instruction from being given due to the switch 36 or 37 being wrongly operated during a very short period of time. An output signal from the AND circuit 38 is forwarded to an AND circuit 44, together with an output signal from the frequency divider 13. An output signal from the AND circuit 44 is transmitted to a ring counter 45. Where the switches 36, 37 are jointly operated, then said ring counter 45 counts output signals from the frequency divider 13. The ring counter 45 repeats counting by circulation, and issues a carry signal each time a specified number of signals are counted. Namely, each time the joint operation of the switches 36, 37 continues for a unit length of time, for example, 5 seconds, the ring counter 45 produces an output signal. An output signal from the ring counter 45 is carried to an AND circuit 46, together with an output signal from the AND circuit 38. An output signal from the AND circuit 46 causes a count made by an n-scale counter to be advanced. With this embodiment, count output lines of 0 to 3 of a 4-scale counter 47 are connected to a function-selecting circuits 32 formed of, for example, a matrix circuit. According to a count output signal from the function-selecting circuit 32, the control circuit 23 is supplied with an instruction conforming to a program set in the matrix circuit. The function-selecting circuit 32 supplies the display control circuit 22 with a display-selecting instruction. Where the 4-scale counter 47 counts zero, the control circuit 23 receives an instruction for display to be changed over and an instruction for setting a stopwatch function. An output signal from the control circuit 23 renders the display control circuit 16 ready for the switching of display, and causes the function-counting circuit 24 to be set for a stopwatch function. The function-selecting circuit 32 is further supplied with output signals from the AND circuits 39, 41. An output signal from the AND circuit 39 acts as an instruction for the switching of display with respect to, for example, the control circuit 23. This display-shifting instruction is supplied to the display control circuit 16 through the control circuit 23. The AND circuit 58 included in the display control circuit 16 selects count signals issued from the date counter 15 to specify a given date. Said specified date is conducted through the OR circuit 20 and decoder 21 to be indicated on the display device 22. An output signal from the AND circuit 41 acts as an instruction for the setting of a stopwatch function with respect to the control circuit 23. This stopwatch function-setting instruction renders the function-counting circuit 24 ready for a stopwatch function. Since, in this case, an output signal from the AND circuit 39 is not selected by the function-selecting circuit 32. The AND circuit 28 included in the display control circuit 16 selects an output signal from the function-counting circuit 24 upon receipt of an instruction issued from the control circuit 23. As the result, a time count made by the subject electronic timepiece serving as a stopwatch is indicated on the display device 22. An output signal from the AND circuit 38 is supplied to a one-shot circuit which is formed of a delay circuit 48, inverter 49 and AND circuit 50 and is designed to detect the fall of said output signal from the AND circuit 38 resulting from the release of the joint depression of the two switches 36, 37. Said output signal from the AND circuit 38 controls the operation of another one shot circuit, which is formed of a delay circuit 51, inverter 52 and AND circuit 53 and is designed to detect the fall of an output signal from the first mentioned one shot circuit. When the joint operation of the switches 36, 37 is released, then the AND circuit 50 produces a one-shot output signal. The AND circuit 53 also sends forth a one-shot output signal slightly later than the former one-shot output signal. A one-shot output signal from the AND circuit 53 is supplied as a reset instruction to a flip-flop circuit 54 which is set by an output signal from the ring counter 45. A reset output signal from the flip-flop circuit 54 is conducted to an AND circuit 55 together with an output signal from the AND circuit 50. An output signal from the AND circuit 55 resets the n-scale (4-scale in this embodiment) counter 47.

Where an electronic timepiece arranged as described above counts time as an ordinary timepiece, then the 4-scale counter 47 remains reset, and indicates a count of "0". Under this condition, the display device 22 indicates current time, for example, 12 hours: 58 minutes: 30-second order as shown in FIG. 2A. Where, under the above-mentioned "0" count condition, the first switch 36 is throwing, then the AND circuit 39 generates an output signal. The control circuit 23 gives an instruction to the display control circuit 16 through the function-selecting circuit 32. As the result, the time display (FIG. 2A) based on a time count signal delivered from the time counter 14 can be replaced by a date display of, for example, 8 (months): 30 (days), Friday, as shown in FIG. 2B by supplying date counting signals from the date counter 15 to the display device 22 through the AND circuit 58.

Where the second switch 37 is operated while the 4-scale counter 47 remain reset, that is, is kept in a "0" count condition to cause the subject electronic timepiece to commence a stopwatch function, then the AND circuit 41 issues an output signal and the function-selecting circuit 32 supplies a control signal to the binary counter 31 of the control circuit 23 from the matrix function-selecting circuit 32. An output signal from the binary counter 31 is transmitted to the AND circuit 25 and counter 27 both included in the function-counting circuit 24. Each time the second switch 37 is operated on and off, the function-counting circuit 24 causes counting of clock pulses supplied from the frequency divider 13 to be continued and stopped accordingly, thereby realizing a stopwatch function. While the subject electronic timepiece is operated as a stopwatch function, the contents of the function counter 27 are supplied to the display device 22 through the AND circuit 28 included in the display control circuit 16, thereby indicating a counted time, for example, 3 minutes: 25 seconds, as shown in FIG. 2C, as the result of the stopwatch function.

The foregoing description refers to the case where the first or second switch 36 or 37 alone was operated while the function counter 47 was reset at a "0" count. Selection of other functions is effected by the undermentioned processes. Where the first and second switches 36, 37 are jointly operated, then the AND circuit 38 issues an output signal. A period of time during which the AND circuit 38 continues to produce an output signal is measured by the ring counter 45 which counts output signals supplied from the frequency divider 13 through the AND circuit 44. Each time the joint operation of the two switches 36, 37 continues, for example, 5 seconds, an output signal from said ring counter 45 is supplied to the 4-scale counter 47 through the AND circuit 46 to cause counts made by said counter 47 to be successively advanced. Accordingly, the counts thus advanced, the function-selecting circuit 32 is set to given an instruction for a prescribed function. Table 1 shows the kinds of function corresponding to the counts made by the 4-scale counter 47, and the contents of the respective functions effected by operation of the switch 36, or 37 alone. The functions are selected by the function-selecting circuit 32.

Table 1

| Counts made by the 4-scale counter | Period of joint operation of switches 36 and 37 | Form of display | Kind of function | Function of switches 36 and 37 |
|---|---|---|---|---|
| 0 | | | Change over of display | 36—convert time to and from date |
| | | | Stop-watch function | 37—convert time counting to and from stoppage |
| 1 | 5 to 10 seconds | Intermittent display of colons | Designation of adjustment | 36—clear seconds to adjust minutes<br>37—clear seconds and minutes to adjust hours |
| 2 | 10 to 15 seconds | Display of hours alone | Designation of increase or decrease of hours indicated | 36—increase hours by 1<br>37—decrease hours by 1 |
| 3 | 15 to 20 seconds | Display of enumeration digits | Designation of enumerator function | 36—increase an enumerated number successively by 1<br>37—convert of time counting to end from enumeration |

Figure 2D:
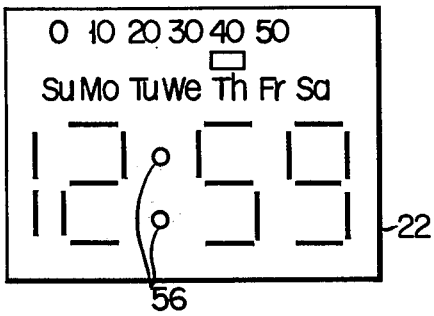

There will now be described Table 1 above. Where the first and second switches 36, 37 are jointly operated for 5 to 10 seconds, then a carry signal issued from the ring counter 45 causes a count made by the 4-scale counter 47 to be advanced from zero to 1. At this time, colons 56 shown in FIG. 2D are flickered on the display device 22. Flickering of the colons 56 is effected by selecting out 2 Hz output signals from the time counter 14 by an AND circuit 60 included in the display control circuit 16. Where the joint operation of the first and second switches 36, 37 is terminated upon the appearance of said flickering of the colons 56, then the 4-scale counter 47 is stopped at a count of 1. Where the first switch 36 is operated under this condition, then an output signal from the AND circuit 39 is supplied to the function-selecting circuit 32, which in turn gives an adjustment-instructing signal to the gate of the OR circuit 30 included in the control circuit 23. An output signal from the OR circuit 30 clears a count made by a second counter included in the time counter 14. The adjustment-instructing signal issued from the function-selecting circuit 32 adjusts a count of minutes made by the minute counter included in the time counter 14 by increasing said count by 1. When the second switch 37 alone is operated while the 4-scale counter 47 is kept at a count of 1, then an output signal from the AND circuit 41 is conducted to the function-selecting circuit 32, which in turn sends forth an adjustment-instructing signal to the OR circuits 29, 30 included in the control circuit 23. An output signal from the OR circuit 30 clears counts made by the "second" counter included in the time counter 14. The adjustment-instructing signal clears counts made by the "minute" counter included in he time counter 14. An output signal from the OR circuit 29 adjusts a count of hours made by the "hour" counter included in the time counter 14 by increasing said count by 1. Where prescribed functions are executed by the independent operation of the first and second switches 36, 37, then both switches 36, 37 are jointly operated for a short period of time (less than 5 seconds in this case) during which the ring counter 45 does not generate an output signal. Said joint operation is immediately released. As the result, an output signal from the AND circuit 50 is transmitted to one of the gates of the AND circuit 55. Where a count being made by the 4-scale counter 47 is defined by the joint operation of the first and second switches 36, 37 for designation of a function, then the reset terminal R of the flip-flop circuit 54 is supplied with that output signal from the AND circuit 53 included in a one-shot circuit which originates from an output signal from the AND circuit 38. Accordingly, a reset output signal from the flip-flop circuit 54 is conducted to the other gate of the AND circuit 55. An output signal this AND circuit 55 resets a count made by the 4-scale counter 47, which in turn is restored to the normal condition in which a count of zero is made.

Figure 2E:
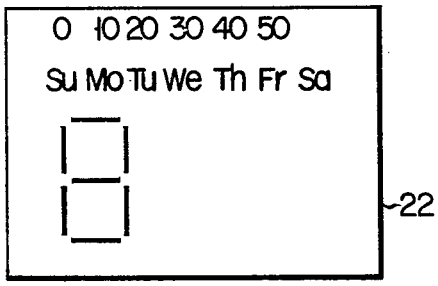

There will now be described a process of selecting any other desired function of the subject electronic timepiece by jointly operating the first and second switches 36, 37 for 10 to 15 seconds and causing the 4-scale counter 47 to count 2 upon receipt of a carry signal from the ring counter 45. Where, under this condition, the first switch 36 alone is operated, then as many output signals as a number of times said first switch 36 is operated are supplied from the AND circuit 39 to the function-selecting circuit 32. An adjustment-instructing signal corresponding to a count of 2 made by the 4-scale counter 47 is delivered to the gate of the OR circuit 29 included in the control circuit 23. An output signal from the OR circuit 29 increases by 1 a count made by the hour counter included in the time counter 14. At this time, an output signal from the 4-scale counter 47 which corresponds to a count of 2 prevents the inverter 59 from producing an output signal through, therefore, a time count sent forth from the AND circuit 19 is not displayed, yet a count of hours alone made by the time counter 14 is indicated on the display device 22 through the AND circuit 57, OR circuit 20 and decoder 21 as shown in FIG. 2E. At this time, a count of hours is corrected by being increased by 1 due to a +1 upcounting signal being supplied to the hour counter included in the time counter 14. Thus, a count of 8 (FIG. 2E) indicated on the display device 22 is successively increased by 1, each time the first switch 36 is operated. Where the second switch 37 alone is actuated while the 4-scale counter 47 is kept at a count of 2, then an output signal from the AND circuit 41 is sent forth to the function-selecting circuit 32 to decrease by 1 a count of hours made by the "hour" counter included in the time counter 14.

Figure 2F:
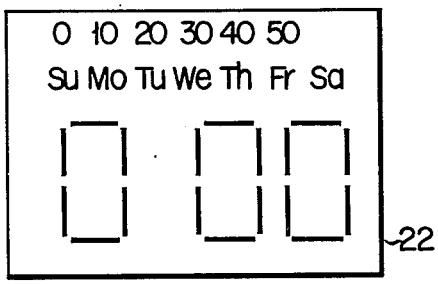

There will now be described a process of selecting any other desired function of the subject electronic timepiece by jointly operating the first and second switches 36, 37 for 15 to 20 seconds and causing the 4-scale counter to make a count of 3. At this time, output signals from the time counter 14 which correspond to "seconds", "minutes" and "hours" are stopped at the AND circuit 19 by the inverter 18 included in the display control circuit 16. As the result, the display device 22 makes a display such as "0 0 0" (FIG. 2F). Where, under this condition, the first switch 36 alone is operated, then the AND circuit 39 produces an output signal, which in turn is conducted through the function-selecting circuit 32 to the OR circuit 26 of the function counter 24. At this time, the function counter 27 counts a number of times the first switch 36 is operated. A count output signal from the function counter 27 is indicated on the display device 22 through the AND circuit 28, OR circuit 20 and decoder 21 in turn. Where, under the above-mentioned condition, the second switch 37 is alone operated, then an output signal from the function-selecting circuit 32 is supplied to the inverter 35 upon receipt of an output signal from the AND circuit 41. Since the AND circuit 33 is prevented from issuing an output signal, counts of "seconds", "minutes" and "hours" made by the time counter 14 are displayed on the display device 22 through the inverter 18 and AND circuit 19. Namely, where, under the above-mentioned condition, the second switch 37 alone is operated, then the display of enumeration digits "0 0 0" on the display device 22 is changed over to that of counts of "seconds", "minutes" and "hours".

The foregoing embodiment included a ring counter 27 for measurement of time. However, it is obviously possible to omit said ring counter 27 by utilizing a function counter used as a timer counter.

Further, the embodiment refers to the case where two switches were provided. Of course, the switches may be provided in any other number, for example, 3. Where a larger number of switches than 3 are used, an instruction for a specified function can be given by joint operation of a plurality of switches. The kinds of function are not limited to those describe in connection with the illustrated embodiment, but it may be contemplated to cause the subject electronic timepiece to undertake other functions, for example, that of a global timepiece with addition of arrangements conforming to said other functions.

This invention is not limited to uses described herein, but may obviously be adapted for many other applications with proper modifications without changing the object and scope of the invention.

What is claimed is:

1. An electronic timepiece including a reference oscillator generating reference clock signals, a time count circuit coupled to said reference oscillator for counting reference clock signals from said reference oscillator, a display device coupled to said time count circuit for displaying a count value of the time count circuit, and switch means comprising at least two independent, manually operable switches, the timepiece further comprising:

detecting means coupled to said switch means for detecting the simultaneous operation state of at least two switches of said switch means;

function setting means coupled to said detecting means for detecting that the simultaneous operation state detected by said detecting means is continued for a predetermined time and for designating a different function from a time count function responsive to said simultaneous operation state being continued for said predetermined time; and function executing means coupled to said function setting means for performing the designated different function by operating at least one switch of said switch means.

2. The electronic timepiece of claim 1, wherein a different function from said time count function includes a time correction function of said time count circuit, and wherein the time correction function is designated by the function setting means when said simultaneous operation state of said switch means is continued for a predetermined time period.

3. The electronic timepiece of claim 1, further comprising another time count circuit for a different function operation in addition to said first-mentioned time count circuit, and wherein a different function is designated by said function setting means when said simultaneous operation state of said switch means is continued for a predetermined time.

4. An electronic timepiece including a reference oscillator generating reference clock signals, a time count circuit coupled to said reference oscillator for counting reference clock signals from said reference oscillator, a display device coupled to said time count circuit for displaying a count value of said time count circuit, and switch means comprising at least two independent, manually operable switches, the timepiece further comprising:

detecting means coupled to said switch means for detecting the simultaneous operation state of at least two switches of said switch means;

function setting means coupled to said detecting means for identifying the duration time of said simultaneous operation state detected by said detecting means and selectively designating each of a plurality of functions corresponding to respective identified time durations of the simultaneous switch operation; and function executing means coupled to said function setting means for executing a selected function by either one of the switches of said switch means.

5. The electronic timepiece of claim 4, wherein said function setting means includes a plurality of stages of counters corresponding to individual functions; and unit time signal generating means for generating count step signals for each predetermined time unit of the duration time of said simultaneous switch operation state and for sending said count step signals to said counter stages.

6. The electronic timepiece of claim 5, wherein said function executing means includes a matrix circuit which provides respective selective outputs corresponding to an output from each counter stage and an individual operating output of said switch means.

7. The electronic timepiece of claim 5, further including further detecting means for providing a detection output when the duration period of said simultaneous switch operation state of said switch means is less than a predetermined short period of time, and means for setting the counter to the initial state responsive to said detection output from said further detecting means.

8. The electronic timepiece of claim 4, wherein said different functions of the electronic timepiece include a time correction function.

9. The electronic timepiece of claim 5, further comprising another count circuit for a plurality of function operations in addition to a time count operation, one of said plurality of function operations being selected by the counter stages of said function setting means, the selectively designated function being executed by said another count circuit.

10. The electronic timepiece of claim 9, wherein said another count circuit comprises a time count device for at least one of a stopwatch mode and a time count operation of a counter.

11. The electronic timepiece of claim 5 wherein said time count circuit comprises a plurality of frequency division stages, and wherein said unit time signal generating means comprises a ring counter coupled to said time count circuit for counting clock frequency signals from one of the plurality of frequency division stages and for generating at least one of said count step signals for each of said predetermined time units.

12. The electronic timepiece of claim 11 in which said predetermined time unit is 5 seconds.

13. The electronic timepiece of claim 5 in which said predetermined time unit is 5 seconds.

* * * * *